US006042428A

United States Patent [19]

Espiritu et al.

[11] Patent Number: 6,042,428

[45] Date of Patent: Mar. 28, 2000

[54] CONNECTOR INSERT RETENTION

[75] Inventors: Hermenegildo Altares Espiritu, Cerritos; Peter Joseph Hyzin, Lake Forest, both of Calif.

[73] Assignee: ITT Manufacturing Enterprises, Inc., Wilmington, Del.

[21] Appl. No.: 09/102,548

[22] Filed: Jun. 22, 1998

[51] Int. Cl.[7] ..... H01R 13/502

[52] U.S. Cl. ..... 439/686; 439/903

[58] Field of Search ..... 439/686, 598, 439/597, 903, 904, 682

[56] References Cited

U.S. PATENT DOCUMENTS

| | | | |
|---|---|---|---|
| 3,570,096 | 3/1971 | Sosinski . | |
| 3,885,849 | 5/1975 | Bailey et al. . | |
| 3,926,499 | 12/1975 | Bailey et al. . | |
| 3,951,514 | 4/1976 | Medina, Jr. . | |
| 3,993,394 | 11/1976 | Cooper . | |
| 4,084,882 | 4/1978 | Hogan et al. . | |
| 4,155,159 | 5/1979 | Hogan et al. . | |
| 4,193,655 | 3/1980 | Herrmann, Jr. . | |
| 4,361,376 | 11/1982 | Gallusser et al. . | |
| 4,413,875 | 11/1983 | Mattingly . | |
| 4,477,022 | 10/1984 | Shuey et al. . | |
| 4,659,162 | 4/1987 | Cartesse . | |
| 4,684,187 | 8/1987 | Rudy, Jr. et al. | 439/600 |
| 4,764,130 | 8/1988 | DiClemente | 439/686 |
| 4,834,678 | 5/1989 | Emandi et al. | 439/701 |
| 4,927,388 | 5/1990 | Gutter | 439/660 |
| 4,985,002 | 1/1991 | Maisch et al. | 439/607 |
| 5,145,411 | 9/1992 | Pastal et al. | 439/598 |

*Primary Examiner*—Neil Abrams
*Assistant Examiner*—Eugene G. Byrd
*Attorney, Agent, or Firm*—Thomas L. Peterson

[57] ABSTRACT

A connector (10) that includes an insert (14) with contact-holding passages (16), is retained in a shell (12) by a pair of resilient sheet metal tines (30). The rear portion of the shell is provided with forwardly-facing shoulders (60) at the inside of the shell, and a pair of tines (30) are mounted on the insert. Each tine has a mount portion (40) fixed in the insert isolator (36), a first section (42) extending at a rearward (R) and outward (O) incline so the rear end (44) of the first section lies directly forward of the shoulder, and a second section (50) extending inwardly (I) from the rear end of the first section and having a tab (52) to enable inward deflection of the tine to release it from the shoulder. The tine generally lies in a cavity (46) at the rear of the insulator and at a side thereof, to enable a tool to be used to deflect the tab and release the insert.

8 Claims, 3 Drawing Sheets

10
12
14
20
21
30
30A
36
40
41
42
44
46
50
52
54
56
60
61
62
63
64
66
F
L
M
R
I
O

CONNECTOR INSERT RETENTION

BACKGROUND OF THE INVENTION

Electrical and optic connectors commonly include an insert with a plurality of parallel contact-receiving passages, with the insert received in a shell. The insert is commonly inserted forwardly into an open rear of the shell, and is held therein by any of a number of devices, including screws and sidewardly-slideable retainer plates. A simple means for retaining an insert in a shell, which facilitated removal of the insulator from the shell when necessary, would be of value.

SUMMARY OF THE INVENTION

In accordance with one embodiment of the present invention, a mechanism is provided for retaining a connector insert within a shell, which automatically retains the insert after it has been fully installed, which enables easy and rapid removal, which uses simple sheet metal parts, and which enables rearward removal of the insert by a tool inserted into the rear of the connector. The insert is provided with cavities at opposite sides of its rear end. The shell is formed with its rear part having a forwardly-facing shoulder on its inside. The insert has a cavity facing the shell shoulder, and has a resilient sheet metal tine with a front mount portion fixed to the rest of the insert. The tine has a first section extending at a rearward and outward incline from the mount portion so the rear end of the first section lies immediately forward of the shell shoulder. The tine also has a second section that extends inwardly along the shell shoulder, and has a tab at the inner end of the second section. The second section substantially abuts the shell shoulder to prevent insert removal. However, when the tab is deflected inwardly by a tool inserted into the cavity at the rear of the connector, the insert can be removed.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
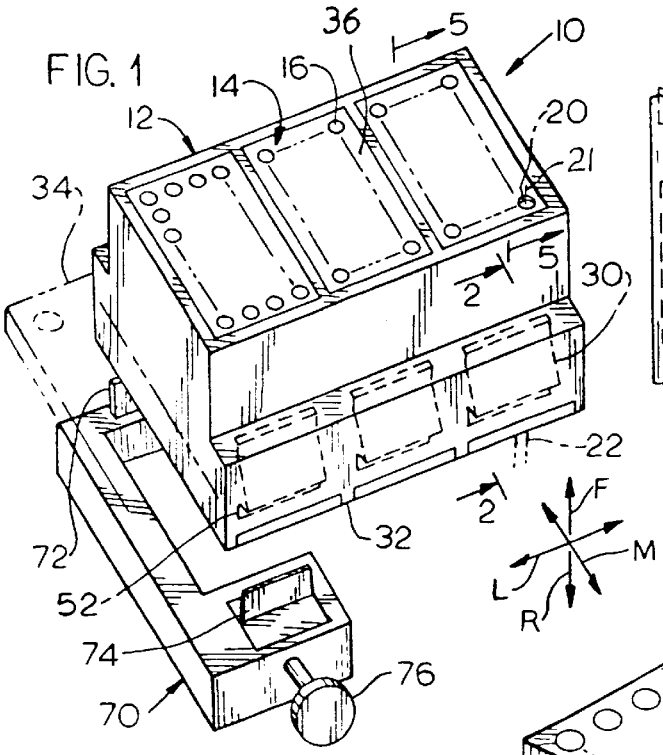
FIG. 1 is a front isometric view of a connector constructed in accordance with the present invention, and also showing an example of a tool that can be used to remove the insert from the shell.
Figure 8:
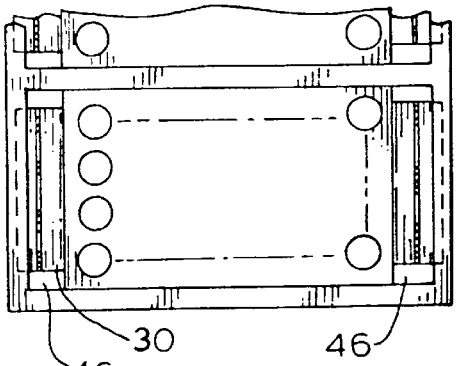
FIG. 8 is a partial rear elevation view of the connector of FIG. 1.

FIG. 1 illustrates a connector 10 which includes a shell 12 and inserts 14, with the figure showing three inserts spaced in a lateral direction L. Each insert includes a plurality of contact-holding passages 16 that receive electrical or optic contacts, for connecting to similar contacts of another connector. Each of the contacts such as contact 20 extends along its passage axis 21 and has an electrical wire or optical fiber assembly 22 extending in a rearward direction R from the rear end of the insert passage. The inserts are designed to be inserted in a forward direction F into the shell. A plurality of tines 30, lying at longitudinally M opposite sides of each of the three inserts, serves to retain the corresponding insert in the shell. The connector is constructed so the tines 30 can be operated to release a corresponding connector, from the rear end 32 of the shell, which is the end from which the insert is withdrawn from the shell. It is noted that mounting flanges such as indicated at 34 are sometimes provided on shells, for mounting on walls of equipment, and release of the tines from the same rearward end out of which the insert is pulled, is desirable especially where there is not ready access to connector locations forward of the mounting flange.

Figures 2, 3, 4:
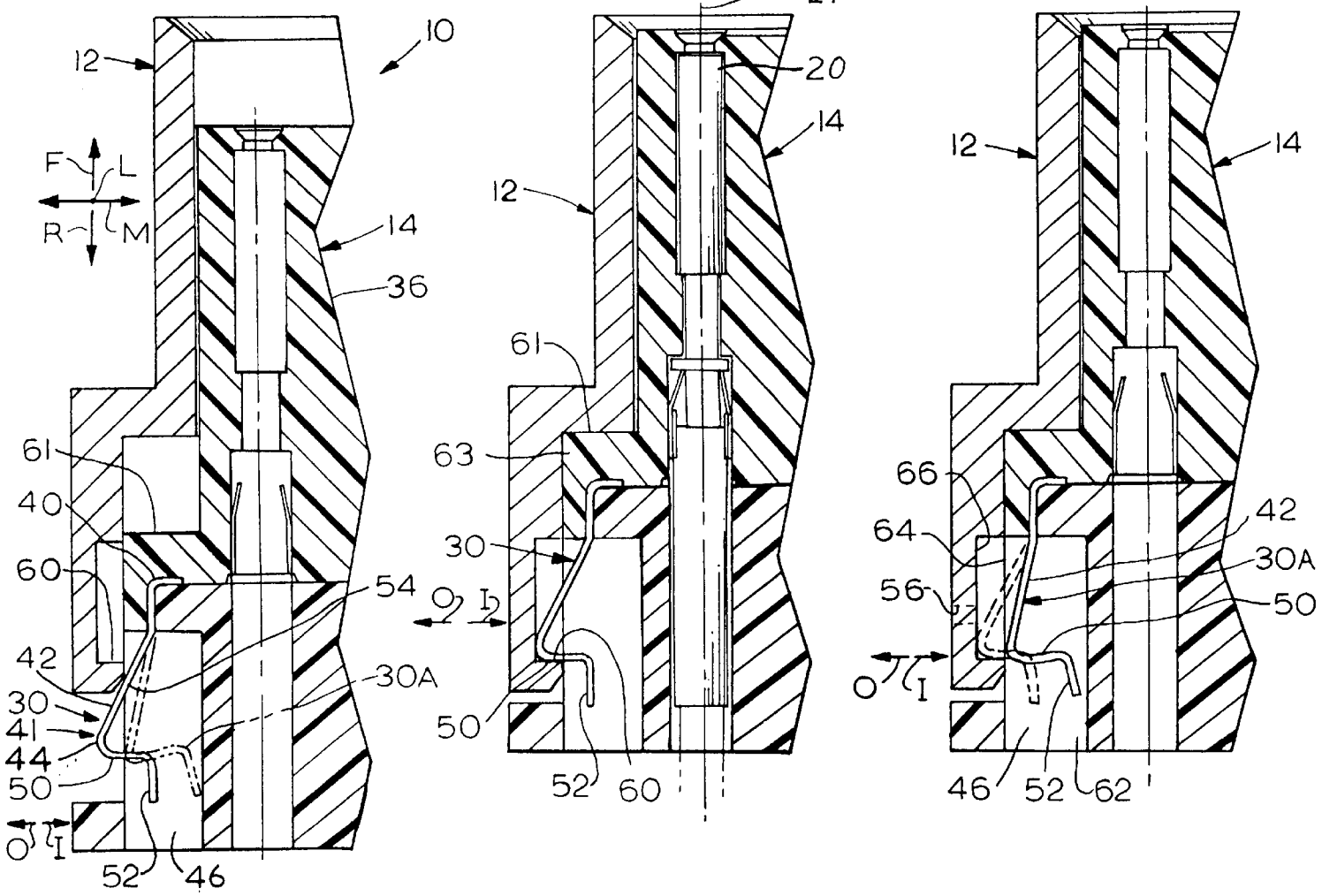
FIG. 2 is a sectional view taken on line 2—2 of FIG. 1, showing the insert prior to its full insertion into the connector shell.
FIG. 3 is a view similar to that of FIG. 2, but showing the insert fully inserted into the shell.
FIG. 4 is a view similar to that of FIG. 3, but with the tine deflected to enable removal of the insert from the shell.
Figure 5:
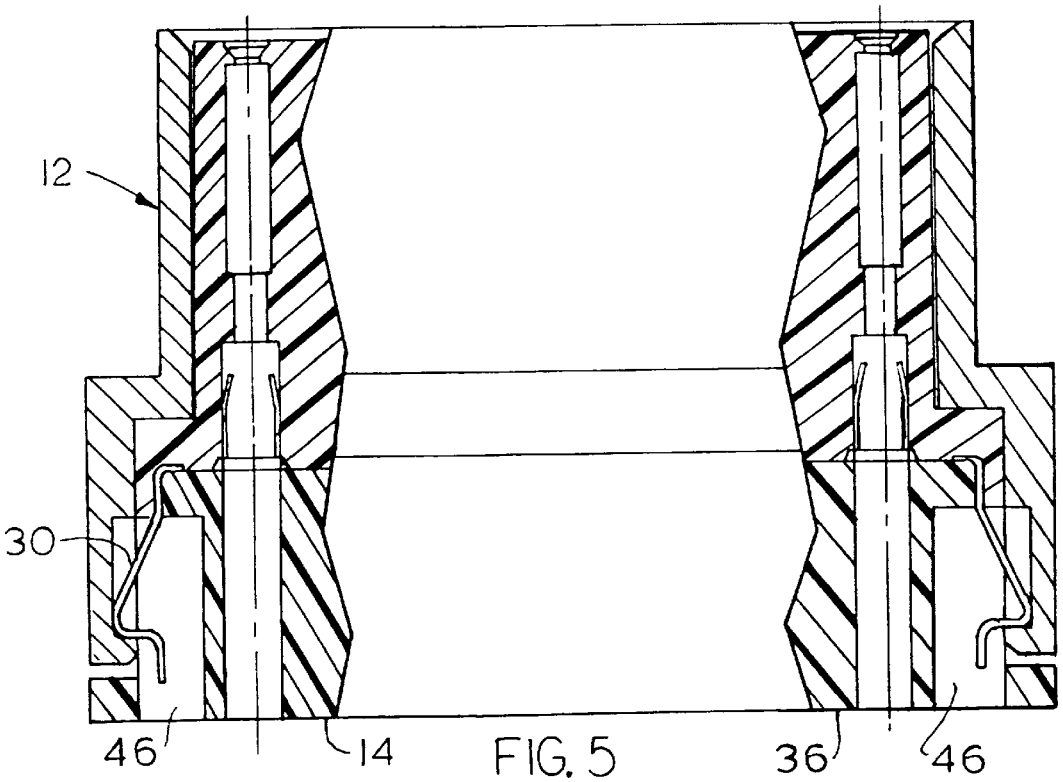
FIG. 5 is a sectional view taken on line 5—5 of FIG. 1.
Figure 6:
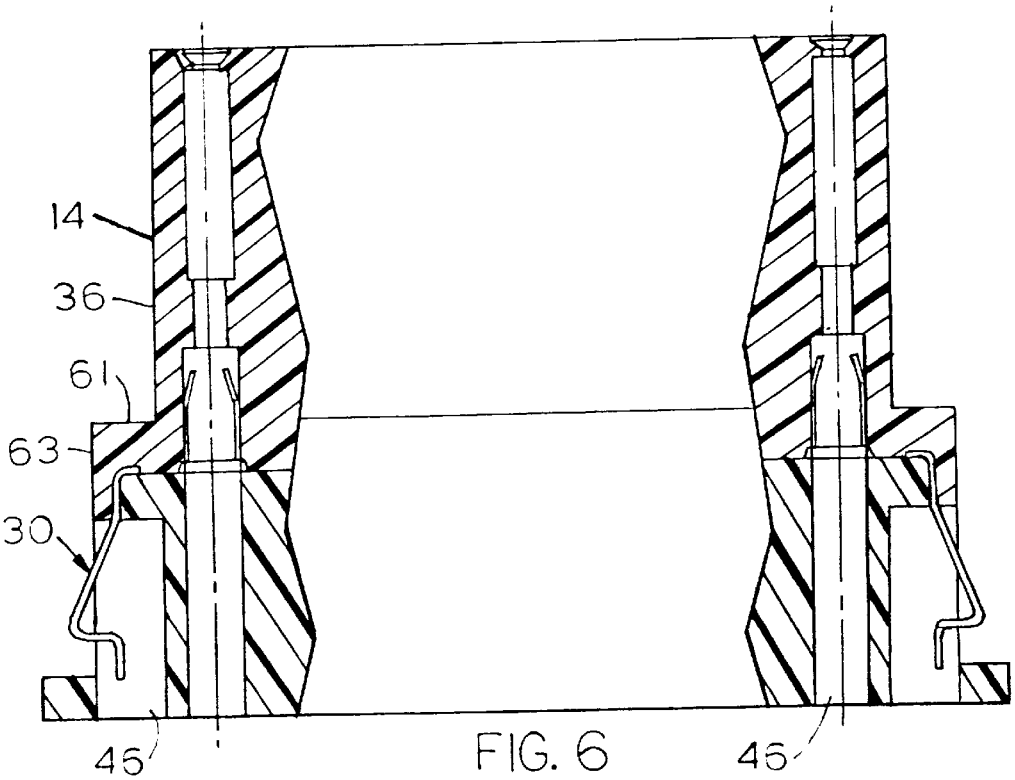
FIG. 6 is a view of the insert of FIG. 5, without the shell.

FIG. 2 illustrates a portion of the connector 10, showing one of the inserts 14 as it is being installed by moving it forwardly F into the shell 12. The insert includes an isolator, or insulator 36 and a pair of tines 30. It is noted that for an optic fiber connector, the isolator or insulator can be formed of electrically conductive material such as metal. Each tine 30 has a forward mount portion 40 that is fixed in position within the insert isolator. The tine has a free portion 41 with first and second sections 42, 50 and a tab 52. The first section 42 extends at an outward 0 and rearward R incline from the mount portion 40, with the rear end 44 of the first section extending sidewardly (in direction M) beyond a cavity 46 formed in the insert isolator. A primarily rearwardly-facing second section or tine shoulder 50 extends inwardly I from the rear end of the first section, and a tab 52 extends rearwardly from an inner end of the second section 50. As the insert is pushed forwardly into the shell, a surface 54 of the shell deflects the tine inwardly to the position 30A Finally, when the insert becomes fully inserted, as shown in FIG. 3, the tine snaps back to its original lock position 30. In the position of FIG. 3, the tine second section shoulder 50 lies directly forward of a shell shoulder 60 that faces primarily forwardly. The shell shoulder 60 prevents rearward movement of the insert 14 out of the shell. Forwardly-facing surfaces 61 of longitudinally-projecting isolator side projections 63, limit forward movement of the isolator.

FIG. 4 shows the tine in its release position 30A, which is accomplished by deflecting the tab 52 inwardly. Such deflection of the tab and corresponding deflection of the first and second sections 42, 50 enables the insert 14 to be removed, as by pulling rearwardly on the wires or fiber assemblies extending rearwardly from the insert. Although wires or fiber assemblies extend from the rear of the insert and occupy a region immediately rearward of the contact-holding passages, the rear of the cavity 46 lies at a longitudinal side of the wires and is not covered. In some applications, a side hole indicated at 56 may be provided for insertion of a thin tool to deflect the tine, but applicant generally prefers that the tool be inserted into the rear of the shell, through the rear 62 of the cavity 46, since the rear is open when the insert is removed from the rear of the shell. It is noted that the cavity has an open longitudinally-facing (in outward direction O) cavity side 64, but that is open only to a recess 66 in the shell.

A variety of simple tools can be used to deflect the tabs sidewardly. FIG. 1 shows one example of a tool 70 for deflecting a pair of tabs to remove a connector. The tool includes a fixed forwardly-projecting flange 72 and a moveable flange 74 that is moved when a button 76 is depressed against the force of a spring (not shown) to move the tine tabs 52 together. Where it is desired to make insert removal not as obvious to avoid persons "playing" with the connector, it is possible to not have a tab, but to instead provide a hole in the second section 50 of the tine, into which a pin or other tool can be inserted to deflect the tine.

Figure 9:
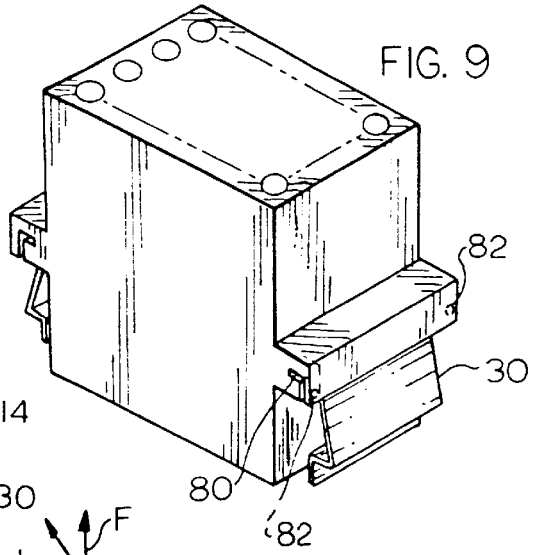
FIG. 9 is a front isometric view of only the insert of a connector constructed in accordance with another embodiment of the invention.
Figure 7:
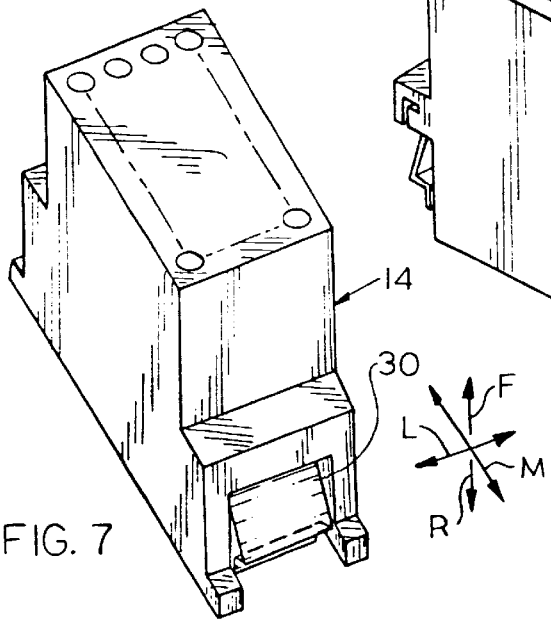
FIG. 7 is a front isometric view of only the insert of the connector of FIG. 1.

The mount portion 40 (FIG. 2) of the tine can be fixed in the insert in a number of ways. One way is to mold plastic material of the insert isolator 36 around the mount portion 40 of the tine. Another way, shown in FIG. 9, is to provide a slot 80 and to slide the mount portion of the tine along the slot into its final position. Then, the mount portion can be trapped by inwardly deflecting locations 82 of the insert material.

The tine is preferably formed of resilient sheet metal, such as stainless steel sheet metal, which has been plastically deformed to the shape illustrated. Such sheet metal tines can be produced in quantity at low cost and provide high resilience because of their thinness. Each tine preferably has a width in a lateral direction L that is at least one-fourth its length in forward-rearward directions F, R, to provide strength against undesirable tine twisting or collapse. The illustrated tines each has a width equal to its length.

Thus, the invention provides a connector of the type that includes a shell and an insert that can be removed in a rearward direction from the shell, wherein a simple, low cost, and reliable mechanism is provided, that enables release of the insert from the rear of the connector. The mechanism includes a resilient tine that is formed of a piece of sheet metal that has been deformed to its shape. The tine has a front mount portion that is fixed in the insert isolator, a first section extending at a rearward and outward incline, and a second section extending inwardly from a rear end of the first section, with a tab at the inner end of the second section. The shell is formed with a largely forwardly-facing shoulder on its inside, which lies directly rearward of the tine second section, to prevent rearward movement of the tine and therefore of the insert, until the tine is deflected.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector comprising a shell and an insert within said shell, said insert including an isolator having at least one contact holding passage with an axis extending in forward and rearward directions, wherein said insert is insertable forwardly into said shell to a fully inserted position and is removable by rearward movement out of said shell, wherein:

said shell has an outside and an inside, and is formed with a forwardly-facing tine-engaging shell shoulder at its inside; and including a resilient sheet metal tine having a forward mount portion mounted on said isolator, said tine having a rear portion with a bend and with tine portions on opposite sides of said bend, with a first of said portions on one side of said bend extending largely rearwardly from said mount portion to said bend and with the bend forming a rearwardly-facing tine shoulder, with said tine biased toward a lock position wherein said tine shoulder is positioned directly forward of said shell shoulder to substantially abut it, when said insert is fully inserted forwardly into said shell, but with said tine being resiliently deflectable to a release position wherein said tine shoulder does not lie directly forward of said shell shoulder.

2. The connector described in claim 1 wherein:

said isolator is molded of plastic, and said tine forward mount portion is molded into said isolator.

3. The connector described in claim 1 wherein:

said isolator is molded with a slot and said tine forward mount portion is slideable in a lateral direction, which is perpendicular to said axis, along said slot to install said mount portion into said slot.

4. The apparatus described in claim 1 wherein:

said tine has a mount part fixed in said isolator, said tine has a first section extending at a rearward-outward incline to a position adjacent to said shell shoulder, and said tine has a second section extending inwardly from the rear end of said second section;

said tine has a rearward-extending tab at the inward end of said second section, whereby to facilitate tine deflection.

5. Apparatus for use with a connector shell to form a connector, comprising;

an insert having a plurality of contact-holding passages with parallel axes extending in forward and rearward directions, said insert having front and rear portions and laterally opposite sides;

said insert having a cavity (46) at each of said laterally opposite sides with each cavity having an outer side that is furthest from the opposite cavity and an inner side that is closest to the opposite cavity;

a pair of tines lying at said laterally opposite sides of said insert rear portion, each tine being formed of sheet metal and having a forward mount portion fixed in said insert, a first tine section extending within and laterally beyond a corresponding one of said cavities at a rearward and outward incline, and a second tine section (50) extending from a rear end of said first section and largely inwardly therefrom, with each of said cavities having an opening at the rear of said insert leading to said second section to receive a tool for deflecting said second section inwardly.

6. The apparatus described in claim 5 wherein:

each of said tines has a rearward-extending tab at the inward end of a corresponding one of said second sections, whereby to facilitate tine deflection.

7. The apparatus described in claim 5 including said shell, and wherein:

said shell surrounds said insert, and said shell has a rear end which is open to allow access to said cavities from the rear end of said shell.

8. A connector comprising a shell and an insert within said shell, said insert including an isolator having at least one contact holding passage with an axis extending in forward and rearward directions, wherein said insert is insertable forwardly into said shell to a fully inserted position and is removable by rearward movement out of said shell, wherein:

said shell has an outside and an inside, and is formed with a forwardly-facing tine-engaging shell shoulder at its inside; and including a resilient tine having a front end with a mount portion mounted on said isolator and having a rear end lying rearward of said front end, said tine rear end forming a rearwardly-facing tine shoulder, with said tine biased toward a lock position wherein said tine shoulder is positioned directly forward of said shell shoulder to substantially abut it when said insert is fully inserted forwardly into said shell, but with said tine being resiliently deflectable to a release position wherein said tine shoulder does not lie directly forward of said shell shoulder;

said isolator and said shell having rear ends with aligned openings leading to said rear end of said tine.

* * * * *